United States Patent [19]

Schonfeld

[11] 4,327,905

[45] May 4, 1982

[54] DUPLEX COPYING APPARATUS

[75] Inventor: Arnold Schonfeld, Norristown, Pa.

[73] Assignee: Sperry Corporation, New York, N.Y.

[21] Appl. No.: 192,392

[22] Filed: Sep. 30, 1980

[51] Int. Cl.[3] ..... B65H 3/30

[52] U.S. Cl. ..... 271/3.1; 271/22; 271/157; 271/160

[58] Field of Search ..... 271/3.1, 22, 24, 157, 271/160, 170, 163

[56] References Cited

U.S. PATENT DOCUMENTS 4,253,653 3/1981 Bauer ..... 271/22

FOREIGN PATENT DOCUMENTS 2019366 10/1979 United Kingdom ..... 271/160

*Primary Examiner*—Richard A. Schacher
*Attorney, Agent, or Firm*—Marshall M. Truex

[57] ABSTRACT

A duplex copying machine having a simple and automatic method and apparatus for handling paper at a duplex feeding station in a duplex copier is disclosed. A container for holding a stack of paper is removably connected to the duplex copier at a paper feeding station. The stack of paper is aligned and partially confined within the container by vertically extending surfaces which align the edges of the paper sheets within the stack. Top portions connected to the vertical surfaces extend horizontally over a portion of the top sheet of the stack. The stack of paper rests on an intermediate support plate within a container which is biased against the top portions. Extension members connected to opposite sides of the intermediate support plate are disposed to move within slots in opposite sides of the container. A pair of solenoids are connected to contact members and fixed to the duplex copier. When the container is mounted on the duplex copier the contact members come in close proximity to the extension members. When it is desired to automatically deposit sheets of paper having copying on one side into the container for duplex copying, a duplex signal is transmitted to the solenoids which when activated lower the contact members to contact and lower the extension members and the intermediate support plate. This allows the simplexed copied sheets of paper to be deposited in the container under the top portions connected to the vertical surfaces.

4 Claims, 6 Drawing Figures

DUPLEX COPYING APPARATUS

BACKGROUND OF THE INVENTION

This invention relates to an apparatus for holding paper in a paper copier having a duplexing capability (duplex copiers).

Considerations of the cost of paper and convenience of handling make duplex copying desirable. It is also desirable that the inclusion of a duplex feature in a copying machine results in little or no increase in the operations performed by the machine operator or reduction in the speed of copying. Copending U.S. application, Ser. No. 192,269, filed on the same day as this application and assigned to a common assignee, discloses a simple, reliable, and effective duplex printing apparatus for use with high speed laser printers as well as paper copiers. The duplex printing apparatus of the referenced application can be used with a paper copier having two separate paper feeding stations similar to the paper feeding stations of the referenced application. These paper feeding stations include a cassette which stores a plurality of sheets of paper in a stack for automatic delivery into the copier by a paper feeding means. Blank sheets of paper are fed from a first cassette to receive an image on one side of an original. The sheets are then delivered to the second cassette by the duplex printing apparatus where they are disposed to be fed back into the copier to receive an image of a second original on the remaining blank side.

Cassettes used in copiers such as those disclosed in U.S. Pat. No. 3,972,612, which is hereby incorporated by reference as if specifically set forth herein, comprise: a container which encloses a chamber; an intermediate support plate within the container which is biased toward the top of the container by a spring or springs disposed between the intermediate support plate and the bottom of the container; and guide and separation means attached to the container for aligning and confining a stack of paper sheets resting on the intermediate support plate within the container. The guide and separation means usually include upright sections which align the front, sides and back edges of the stack of paper, and an extended section which extends across a portion of the top sheet of paper in the stack and against which the springs below the intermediate support plate push or bias the stack. When it is desired to feed a single sheet of paper into the copier, a portion of a rotating roller is caused to come in contact with the top sheet forcing the front edge of the sheet to move against the front upright sections of the guide and separation means. As the movement continues, the paper begins to buckle until the front edge of the paper slips up over the front upright sections. The top extended sections of the guide and separation means along with the biasing action of the spring ensures that the top sheet is very close to the top of the front upright sections but not above them. The above operation causes only the top sheet of the stack to be separated from the stack for feeding.

A typical mode of duplex copying requires that a plurality of copies of a first original is made and the copies stored. Then a second original is placed in the copier and the copies of the first original are fed back into the machine to receive images of the second original on the remaining blank sides of each of the copies. Special provisions and operating procedures are required in the prior art to accomplish plural duplex copying in this manner. For example, in U.S. Pat. No. 3,972,612, a paper feeding cassette receives simplex copies but is positioned at a discharge station on the machine. The simplex copies accumulate on the internal support plate of the cassette with the front edge of the copies resting above the extended sections of the guide and separating means. The cassette must be removed from the discharge station, the front edges of the simplex copies pressed manually below the top extended sections of the guide and alignment means, and the cassette mounted at a paper feeding station. Alternatively, the internal support plate can be locked in a load position against the action of the biasing spring allowing the single copies to fall below the top extended section of the guide and separating means. Then, when the cassette is repositioned at the paper feed station, the internal support plate must be manually unlocked.

In U.S. Pat. No. 4,017,181, a cassette is disclosed which contains two paper holding chambers. A lower chamber feeds fresh sheets of paper for simplex printing. These sheets are discharged onto a tray and then manually delivered to an upper chamber of the same cassette and the upper chamber is then manually positioned in the cassette to feed the simplex copies back into the machine for duplex copying without removing the cassette.

In each of the above patents, manual operations and attention by the operator are required to provide for duplex printing thereby slowing down the duplex printing operation.

In U.S. Pat. No. 3,645,615, a duplex copying machine is disclosed in which a movable sheet guide is repositioned to guide simplexed copy sheets into a tray forming a portion of a second feeding station. The second feeding station automatically stacks and refeeds the simplexed copy sheets back into the copier for duplexing. If only simplexed copies are required, the movable sheet guide is placed in a position to discharge the simplexed copy sheets into a discharge tray.

In the above patent, to refeed sheets from the feeding station, feed rollers are lowered onto the stack of paper in the tray to contact the top sheet. Various retaining means are provided with the tray to align the edges of the stack on the tray including a front retaining member 70 which includes a top tab 78 that rests on the top sheet of the stack. However, when sheets are first loaded into the second feeding station for duplexing they are positioned on the top of the tab 78. The retaining member 70 with tab 78 must be moved to allow the tab 78 to come to rest on the top sheet of the stack. Then, the feed roller rotates in a first direction to remove the edge of the top sheet from under the tab 78 and then reverses direction to move the top sheet over the tab 78 into the copier. Hence, the action of the duplexing station, although automatic, is quite different and more complicated that the approach described previously in connection with U.S. Pat. Nos. 3,972,612 and 4,017,181.

SUMMARY

The present invention provides a simple and automatic method and apparatus for handling paper at a duplex feeding station in a duplex copier. The invention comprises a container for holding a stack of paper. An alignment means is mounted within the container for aligning the edges of the paper sheets within the stack. The alignment means further comprises a top extended portion which extends partially over the top sheet of the stack. The stack of paper rests on an intermediate support plate within the container. A biasing means is connected between the intermediate support plate and the bottom of the container, and acts to bias the stack of paper against the top extended portion. An automatic lowering means connected to the intermediate support plate lowers the intermediate support plate with the stack of paper to a remote position, the automatic lowering means acting against the force of the biasing means in response to a command from the duplex printing mechanism. Hence, sheets of paper containing simplex printing can be deposited within the container below the top extended portion of the alignment means in an automatic fashion facilitating a speedy operation during the duplex printing mode.

In a preferred embodiment of the apparatus, the container is removably mounted to the duplex copying machine. Each of opposite sides of the container contain a slot, and a pair of extension members which are connected to opposite sides of the intermediate support plate are disposed to move within the slots. When the container is mounted on the duplex copying machine it is disposed in close proximity to a first activating means which is connected to the duplex copying machine. The first activating means is connected to a pair of contact members which come in contact with the tops of the extension members when the container is mounted to the machine. In response to a signal received from the duplex copying machine the activating means is enabled to move the contact members which lowers the extension members in the slots in the sides of the container.

The apparatus of the present invention further comprises an automatic stop means which is partially disposed between the intermediate support plate in the container and the bottom of the container. The automatic stop means stops the intermediate support plate at a first location which is above the remote location within the container when the stack of paper is loaded into the cassette. The automatic stop means upon command from the duplex copying machine allows the intermediate support plate with a stack of paper located thereon to be lowered to the remote position allowing sheets of paper requiring duplex printing to be placed therein. The automatic stop means further comprises at least one arm pivotally mounted to the cassette and removable between a first position and a second position. An interposer is connected to the arm and disposed between the intermediate support plate and the bottom of the cassette when the arm is in the first position. A second activating means, connected to the duplex copying machine and disposed in close proximity to the cassette when the cassette is attached to the duplex copying machine, engages the arm upon command from the duplex copying machine and moves the arm to the second position whereat the interposer is no longer disposed between the intermediate support plate and the bottom of the container.

Other objects, features and advantages of the present invention will become more fully apparent from the following detailed description of the preferred embodiment, the appended claims and the accompanying drawings in which:

DETAILED DESCRIPTION OF THE DRAWINGS

Figure 1:
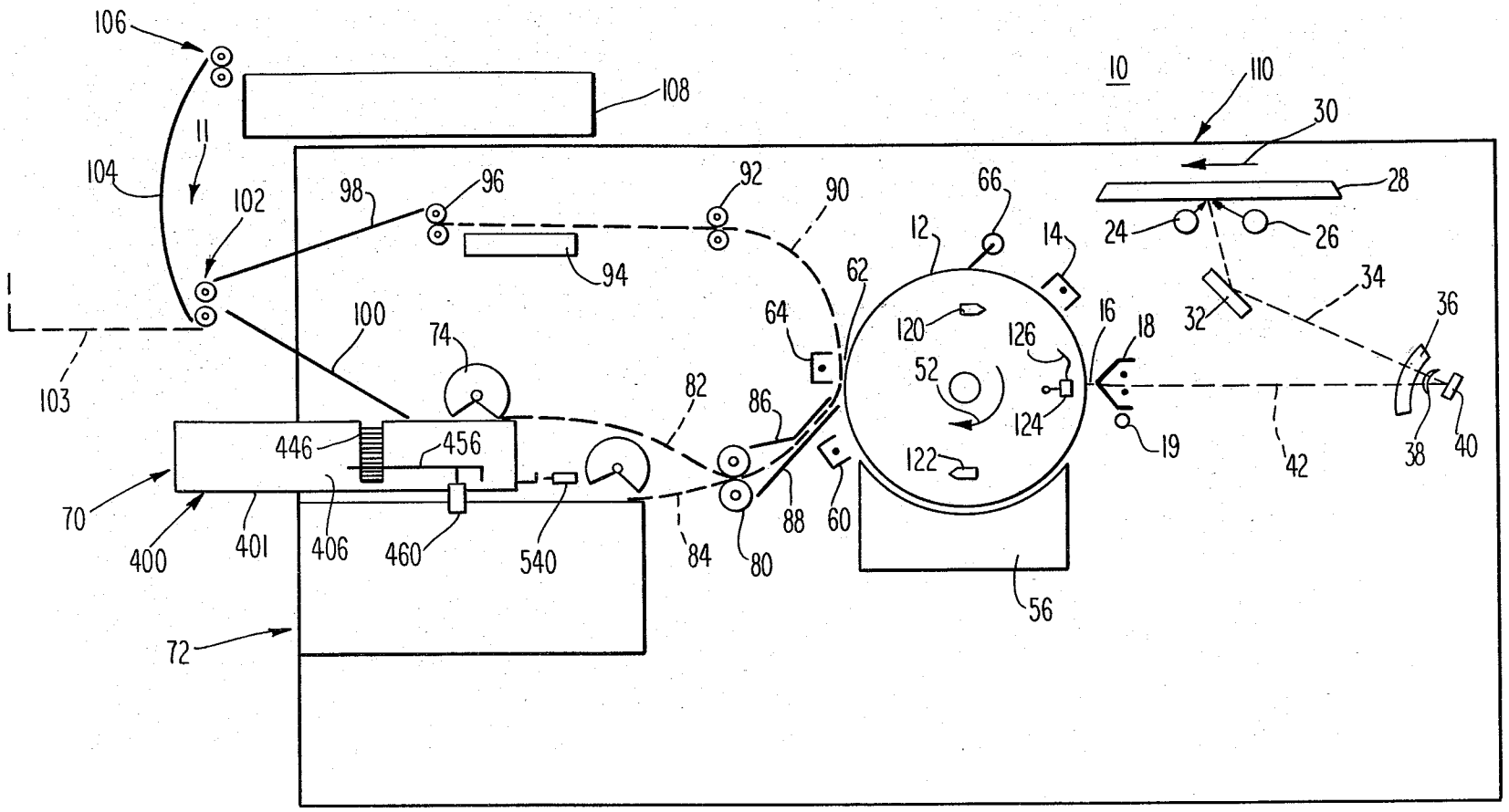
FIG. 1 is a preferred embodiment block diagram of a duplex copying mechanism.

Referring to FIG. 1, a block diagram of a duplex copier designated generally 10 for copying originals on both sides of a sheet of paper is shown. The duplex copier comprises a duplexing apparatus designated generally 11 and a copier portion such as the paper copier disclosed in U.S. Pat. No. 3,972,612. Other paper copiers varying in detail but comprising the essential components of a paper copier are also suitable for use in the preferred embodiment of the present invention.

In general, the duplex copier 10 comprises a photosensitive member such as the rotatable cylindrical photoconducting drum 12. In the example of FIG. 1, a corotron 14 produces a positive charge on photoconducting drum 12 as it rotates thereby. That portion of the photoconducting drum 12 passing by the exposure station 16 is illuminated by light from the optical arrangement designated generally 22 along a linear region parallel to the axis of the photoconducting drum 12, and an AC charge is simultaneously supplied to the photoconducting drum at the exposure station by AC corotron 18. In the preferred embodiment photoconducting drum 12 comprises an innerconducting base layer, an intermediate photoconducting semiconductor layer and an outer insulating layer. When the positive charge from corotron 14 is placed on the surface of the outer insulating layer, a negative charge is induced and trapped at the boundary between the intermediate semiconductor layer and the outer insulating layer. Light from the optical arrangement impinges selected areas of the photoconducting drum in accordance with the desired image to be placed thereon. Whenever light impinges upon the photoconducting drum, the intermediate photoconducting layer conducts the negative charge from the boundary to the base layer. At the same time, the AC discharge neutralizes the positive charge on the surface of the outer insulating layer which facilitates the conduction of the negative charge from the boundary to the base layer. In those regions on the surface of the photoconducting drum where no light occurs, the negative charge at the boundary remains fixed and the neutralizing effect of the AC corotron on the positive surface charge on the outer insulating layer is diminished by the trapped negative charge at the boundary. As a final step the whole surface of the drum near the exposure step is illuminated by exposure lamp 19.

In the preferred embodiment duplex copier exposure of the photoconducting drum is provided by illuminating an original to be copied with lamps 24 and 26. The original is placed on a flat plate of glass 28 and moved in the direction of line and arrow 30 in sychronism with the rotation of drum 12. The light image of the original is reflected from flat mirror 32 along the dashed path 34. The reflected light image from mirror 32 passes through the optical arrangement 22 comprised of lenses 36 and 38 and mirror 40. The reflected light image is reflected from mirror 40 along dashed path 42 to intersect rotating photoconducting drum 12 along parallel linear paths parallel to the axis of the drum. Lenses 36 and 38 provide the proper focusing of the reflected light image of the original onto the drum 12. Depending on the nature of the photoconducting drum 12 (p-type or n-type semiconductor with or without an outer insulating layer) a negative corotron can be used in place of positive corotron 14 and the need for an AC corotron 18 is not always required.

At the exposure station 16 the light transmitted from the optical arrangement 22 images data on the photoconducting drum 12 in the form of electrostatic charges. As the portion of the drum with the electrostatic images rotates, it passes by a developing station which comprises a container 56 which contains a developing solution. The developing solution is pumped onto the photoconducting surface and electrically charged toner material therein adheres to the electrostatic image formed on the drum to thereby develop the image. In the preferred embodiment, a negative corotron 60 removes excessive developing solution from the photoconducting drum 12 without disturbing the toner image.

The photoconducting drum 12 with the toned image is then rotated past transfer station 62 where the charged image on the photoconducting drum 12 is transferred to a sheet of paper passing through the transfer station 62, the transfer occurring because of the voltage of the positive corotron 64. Hence, as a sheet of paper passes by the photoconducting drum 12 at transfer station 62 positive corotron 64 acts as a transfer means for transferring the developed image on the photoconducting drum to one side of the sheet of paper. As the drum continues to rotate the remaining toner left on the photoconducting drum and the developing solution are wiped away from the drum by the edges of a wiper 66. Positive corotron 14 again applies a uniform positive charge to the photoconducting surface of drum 12 which is then ready for illumination at exposure station 16 for imaging of new data.

Sheets of paper are held or stored in paper feeding stations 70 and 72. A sheet of paper is removed from a paper feeding station by activating one of the cammed rollers 74 or 76 respectively. As the cammed roller 74 or 76 rotates the outer circumferential portion engages the top sheet of paper in the paper feeding station 70 or 72 and moves the paper from the paper feeding station into the pinch roller assembly 80 along dashed paths 82 or 84 respectively. The pinch roller assembly 80 is in constant rotation and engages the paper to propel it through the channel formed by paper guides 86 and 88. The paper guides 86 and 88 guide the paper to the transfer station 62 where, through the action of the positive corotron 64, the image on the photoconducting drum 12 is transferred to one side of the paper. The dashed line 82 or 84 along with the dashed line within the channel formed by guides 86 and 88 define a paper feeding path from the paper feeding station 70 or 72 to the transfer station 62.

The dashed line 90 shows the continuation of the path followed by the paper as it leaves the transfer station 62 propelled by roller assembly 92. There are several means known in the art for guiding the paper away from the photoconducting drum 12 along path 90. U.S. Pat. No. 3,972,612 describes such a means by use of a separation belt (25 in U.S. Pat. No. 3,972,612) and a series of turning pulleys. The paper is propelled by roller assembly 92 across a heated platen 94 where the toner is fused to the sheet of paper to permanently fix the image thereon.

After leaving the heated platen 94, the sheet follows a discharge path and is engaged by constantly turning pinch roller assembly 96. As the paper leaves pinch roller assembly 96 it contacts deflection plate 98 and then contacts return plate 100 which guides the paper into duplex roller assembly designated generally 102. The front edge of the sheet of paper is engaged by duplex roller assembly 102 before the back edge of the sheet of paper leaves pinch roller assembly 96. This ensures a positive propulsion of the paper from pinch roller assembly 96 through the contact with the deflection plate 98 and return plate 100 until it is engaged by duplex roller assembly 102.

If copying on the sheet of paper is finished (that is, if copying on both sides of the sheet has occurred, or if only copying on one side has occurred and the other side was not to be copied on) duplex roller assembly 102 continues to rotate in a direction which propels the sheet of paper along a remaining portion of the discharge paper path, the remaining portion defined by curved discharge plate 104. As the sheet of paper is guided by discharge plate 104 it is engaged by rotating roller assembly designated generally 106 which in turn propels the paper through the roller assembly into the discharge station formed by paper cassette 108. The distance between roller assemblies 102 and 106 is also less than a page length.

For the case where only simplex copying is desired, as the sheet of paper travels along curved plate 104 it is turned over so that the side of the sheet with data copied thereon is placed face down in cassette 108.

If it is desired to copy on both sides of the sheet of paper, then a sheet of paper is taken from paper feeding station 72 to pass by the transfer station 62 one time to receive copying on one side. Duplex roller assembly 102 upon receiving the front edge of the simplexed copy sheet rotates for a short time in a direction propelling the sheet of paper toward discharge station 108. However, before the sheet of paper moves entirely through duplex roller assembly 102, the duplex roller assembly is reversed in direction, propelling the paper along return plate 100 into the paper feeding station 70. Note that the copy present on the first side of the sheet of paper is now facing in an upward direction in paper feeding station 70 so that, when the sheet of paper with copy on the first side is removed from the paper feeding station 70 by cammed roller 74 and moved along the paper feeding path partially formed by dashed line 82 and then through the channel formed by guides 86 and 88, the blank side of the paper will be presented to the surface of the photoconducting drum 12 to receive an image thereon.

If it is desired that the side of the sheet with the copy of the first original is placed face down in the cassette 108 then the second original should be copied first and then the first original. This is required when discharge plate 104 and cassette 108 is used. Alternatively, if only duplex copying is to be performed by the machine, the finished copies can be discharged directly into an output cassette adjacent duplex rollers 102. See dashed cassette 103. Then during duplex copying the first original can be copied first and the side with the copy of the first original will be deposited face down in cassette 103.

FIG. 1 shows the outline of a frame designated generally 110. The side walls of the frame are not shown in FIG. 1 but in one embodiment of a duplex copier the photoconducting drum and various roller assemblies are supported by axles or rods which run between and are supported by the sides of the frame 110. Photoconducting drum 12 is rotated by a conventional motor and chain drive assembly. The various roller assemblies are driven off the same motor driving force through subsidiary chain drive arrangements. As the photoconducting drum rotates continuously the various chain drives will also rotate continuously. With some of the roller assemblies it is not desirable to rotate the rollers continuously such as rollers 74 and 76. In these instances, a clutching arrangement can be utilized to activate rotation of the rollers when desired.

Figure 2:
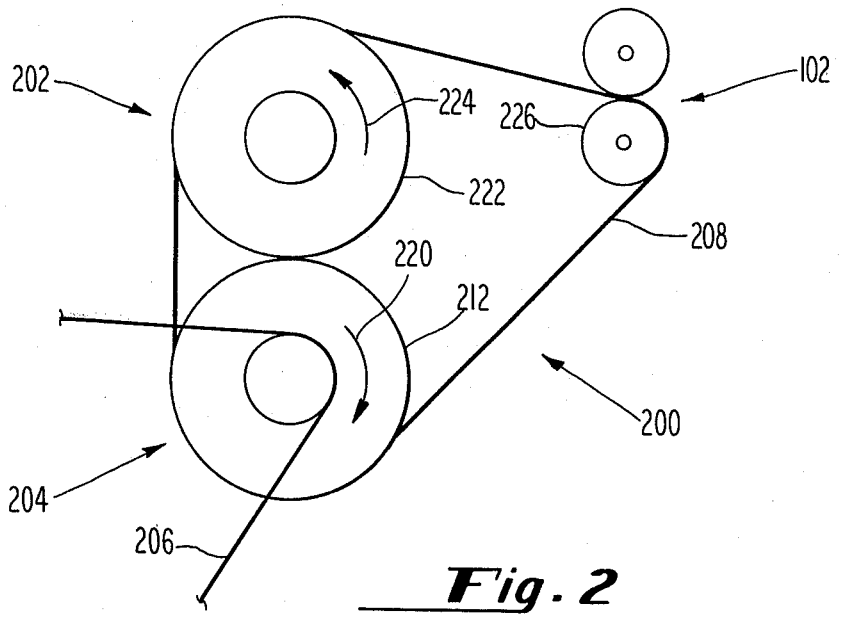
FIG. 2 is an enlarged elevational view of a portion of FIG. 1 including a portion not shown in FIG. 1.
Figure 3:
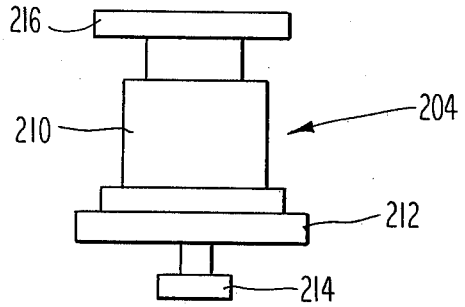
FIG. 3 is a top planar view of a portion of FIG. 2.

FIG. 2 shows a driving arrangement designated generally 200 for driving the duplex roller assembly designated generally 102 in forward or reverse directions. The drive assembly 200 comprises two electromagnetic clutch assemblies designated generally 202 and 204 (made by Ogura Clutch Company, Model No. OTCD-10) and chain drives 206 and 208. FIG. 3 shows electromagnetic clutch assembly 204 in more detail. It comprises a cylindrical electromagnetic clutch body 210, a drive gear 212 attached to one end of the clutch body 210 and concentric therewith, an input drive gear 214 attached to the drive gear 212 and concentric therewith and a sprocket 216 attached to the opposite end of the electromagnetic clutch body 210 from the drive gear 212 and concentric with the clutch body 210. Sprocket 216 is forced to rotate in the direction of drive gear 212 only when the electromagnetic clutch within clutch body 210 is activated, otherwise it is free to rotate in either direction.

Referring once again to FIG. 2, as drive chain 206 moves it rotates the drive gear 212 in the direction of curved line and arrow 220. Drive gear 212 engages drive gear 222 on electromagnetic clutch assembly 202 causing it to rotate in the opposite direction, i.e., in the direction of curved line and arrow 224. A subsidiary drive chain 208 is connected to the sprockets of electromagnetic clutch assemblies 202 and 204 and also to an input gear on duplex roller assembly 102. Depending on which electromagnetic clutch is engaged the drive chain 208 will rotate the roller 226 of duplex roller assembly 102 in one direction or the other. For example, if clutch assembly 204 is engaged then sprocket 216 will rotate in the direction of curved line and arrow 220 (clockwise) forcing the roller 226 to rotate in a clockwise direction also. Alternatively, if the electromagnetic clutch 202 is engaged then the sprocket associated with that clutch will rotate the roller 226 in the opposite or counterclockwise direction.

Figure 4:
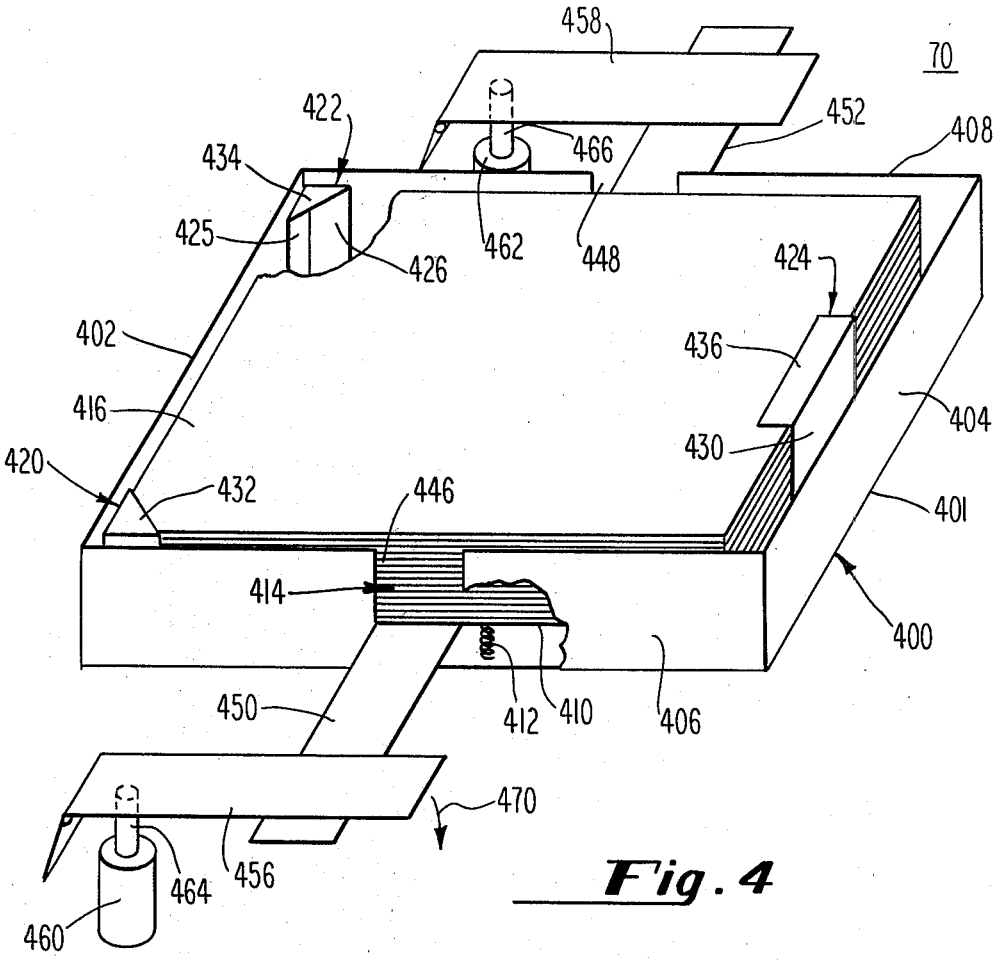
FIG. 4 is a side perspective view of the present invention.

FIG. 4 shows a preferred embodiment of paper feeding station designated generally 70 of FIG. 1. It comprises a cassette designated generally 400 which in turn includes a container 401 with front and back upright sides 402 and 404 and sides 406 and 408. Side 406 is shown partially broken away to expose intermediate support plate 410 within the container 401 and supported by a biasing means such as spring 412 to the bottom of the container 401. Intermediate support plate 410 is shown supporting a stack of paper comprising a plurality of sheets and designated generally by the lines 414. The top sheet of stack 414 is labelled 416. In an alternate embodiment, biasing means 412 is fixed to the duplex copier and engages the bottom of intermediate support plate 410 when the cassette is mounted at a paper feeding station on the copier.

The cassette 400 further comprises front upright sections designated generally 420 and 422 and back upright section designated generally 424. The front and side surfaces of the upright sections 420 and 422 such as the front surface 425 and side surface 426 of upright section 422 act to align the front edges and side edges of the stacked paper respectively. The back surface 430 of back upright section 424 functions to align the back edges of the stack. The upright sections 420, 422, and 424 further comprise top extended sections 432, 434, and 436 respectively. These extended sections extend partially across the surface of the top sheet 416 of the stack.

When the stack of paper is placed in the container 401 of the cassette 400 the intermediate support plate 410 is pushed downward against the force of spring 412 to accommodate the stack. The stack of paper is disposed within the containers such that the top sheet 416 fits under the extended portions 432, 434 and 436. The spring 412 acts to bias the stack of paper against the extended sections. The stack of paper is partially confined within the container 401 by the extended sections and because of the action of the spring 412 the top sheet 416 of paper of the stack 414 is always positioned at the top of the container 401.

When it is desired to feed a sheet of paper from paper feeding station 70 to the duplex copier mechanism, roller 74 in FIG. 1 is rotated and the outer circumferential portion of roller 74 contacts the top page 416 of the stack of paper in the cassette 400. As the roller 74 rotates the top page 416 is pushed against the front surfaces 425 of the upright sections 420 and 422. The top page 416 must overcome the restraining forces of the front surfaces 425 of the upright sections. As the top sheet of paper 416 continues to be moved against the front surfaces the paper buckles slightly and the front corners of the paper move past upright sections 420 and 422. There is not, however, enough friction between the remaining pages 414 in the stack and the top page 416 to draw the second sheet forward against the restraining force of the front surfaces 425. Therefore, the second page remains in place in the cassette 400 and the first page is driven off. The spring 412 continues to bias the stack against the extended section thereby insuring that a previous second sheet which is now the top sheet is near the top of the cassette 400 and ready for separation from the stack when the roller 74 is again activated.

When the cassette 400 is used in the copier mechanism 10 of FIG. 1 in a duplex mode sheets which have previously been fed from the paper feeding station 72 and received copying on one side are deposited into paper feeding station 70 by the duplex printing mechanism 11 so that they can be fed a second time to the transfer station 62 of the copying mechanism for second side copying.

Often it is desirable to make many duplex copies of two originals. One manner of accomplishing this is to place the first original on the glass 28 and make a plurality of copies of the first original on a plurality of sheets of paper fed from paper feeding station 72. The plurality of sheets of paper must be returned to the paper feeding station 70. However, they must be placed in the container 401 between the upright surfaces of the upright sections 420, 422, and 424 and under the extended sections 432, 434 and 436. To accomplish this, cassette 400 contains a pair of vertical slots 446 and 448 in the side walls 406 and 408 of the container 401. Extension members 450 and 452 are attached to the intermediate support plate 410 and are disposed to extend outwardly from the container 401 through the slots 446 and 448.

Contact members 456 and 458 are attached to the framework 110 of the duplex printing mechanism 10 of FIG. 1. The exact details of the manner in which the contact members 456 and 458 are attached thereto are not provided in FIG. 1 or FIG. 4 but are believed to be a matter of conventional design to one skilled in the art and are, therefore, not detailed here. The contact members 456 and 458 are so disposed so that when the cassette 400 is attached to the duplex printing mechanism in the position shown in FIG. 1 the extension members 450 and 452 slide under the contact members 456 and 458 in close proximity thereto.

Activating means such as solenoids 460 and 462 are also attached to the duplex printing mechanism 10. Plungers 464 and 466 of solenoids 460 and 462 respectively are attached to the under side of contact members 456 and 458 of the preferred embodiment. When solenoids 460 and 462 are not energized, plungers 464 and 466 extend partially out of the solenoid housings under the action of solenoid springs. When it is desired to deposit a plurality of sheets of paper having simplexed copying of an original thereon and requiring duplex copying with a second original into cassette 400, the solenoids 460 and 462 are energized by a duplex command from the duplex printing mechanism 10. At this time, the plungers 464 and 466 are withdrawn from their extended state as shown in FIG. 4 and this causes the contact members 456 and 458 to move in a downward direction as shown by the line and arrow 470 in FIG. 4. Because the contact members engage the extension members 450 and 452, the extension members are also forced to move in a downward direction causing intermediate support plate 410 and the stack of paper 414 to be lowered in the container 401. This lowering of the stacked paper allows the plurality of sheets of paper having simplexed copying thereon to be deposited within the container 401 under the extended sections 432, 434, and 436. When all the plurality of sheets of paper with simplexed copying have been deposited in the container 401 the solenoids 460 and 462 are deactivated allowing the biasing spring 412 to bias the stack of paper against the extended sections.

A second original is now placed on glass 28 and is copied onto the plurality of sheets of paper just deposited in paper feeding station 70. When the plurality of sheets of paper receive the second side copy they are discharged into either paper output cassette 103 or paper output cassette 108.

Typically, cassettes such as cassette 400 in FIG. 4 are removably attached to the printing mechanism for easy paper loading. After the cassette is removed from the copier, a stack of paper is placed into the container 401 which causes the intermediate support plate 410 to be lowered against the action of the spring 412. Filling the cassette to capacity causes the intermediate support plate to be lowered to its lowest point in the container. Attempting duplexing of a number of sheets soon after cassette 400 has been freshly loaded could cause problems in depositing sheets with simplexed copying back into the container 401 since no or only a small clearance will be present between the extended sections 432, 434, and 436 and the top sheet of the stack even with the intermediate support plate 410 lowered to receive the simplexed copies.

Figure 5:
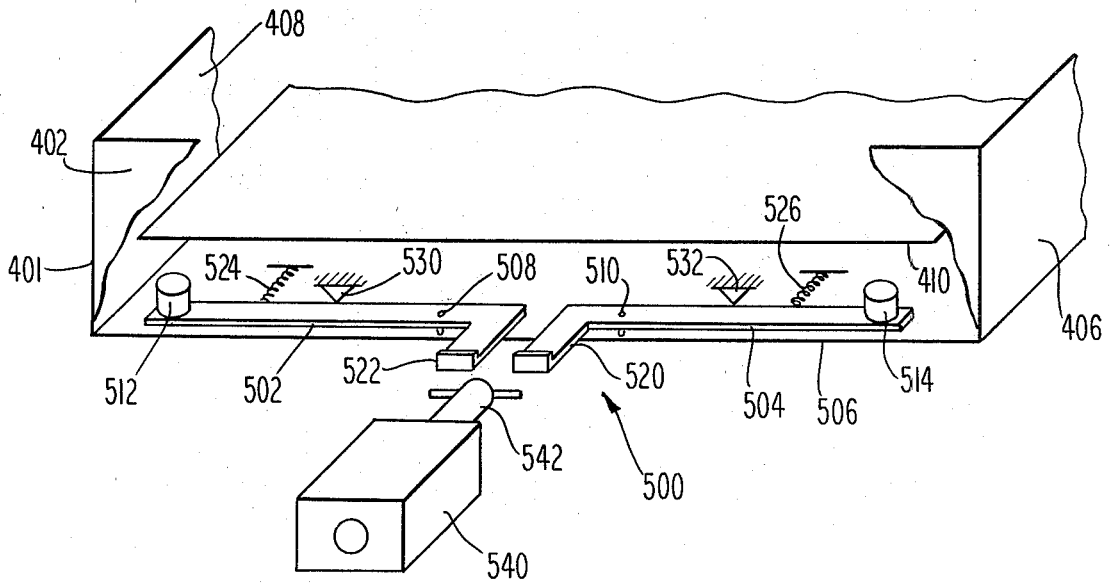
FIG. 5 is an enlarged front prospective view of FIG. 5 with the front side shown cut away and showing a portion not shown in FIG. 4.

To avoid the above mentioned problem, the preferred embodiment of this invention comprises automatic stop means designated generally 500 in FIG. 5 for stopping the intermediate support plate 410 at a first predetermined location which is higher than the lower most location to which the intermediate support plate can be lowered in the absence of the automatic stop means.

The automatic stop means comprises in the preferred embodiment a pair of arms 502 and 504 pivotally connected to the bottom 506 of container 401 at pivot points 508 and 510. The arms 502 and 504 are partially disposed between intermediate support plate 410 and the bottom 506 of container 401. Upwardly extending interposers 512 and 514 are connected to first ends of the arms 502 and 504 respectively. Arms 502 and 504 further comprise outwardly extending contact portions 520 and 522 which extend beyond the front side or wall of container 401. In FIG. 5 the front wall of container 401 is shown broken away. In practice, however, a slot would be removed from the front wall of container 401 to allow movement of the arms and interposers therethrough.

Arms 502 and 504 have connected thereto springs 524 and 526 which act to bias the position of the arms against stops 530 and 532. When the arms 502 and 504 are contacting the stops 530 and 532 respectively the arms are said to be in the first position. In this position the interposers 512 and 514 will prevent the intermediate support plate 410 from being lowered beyond the top of the interposers. In FIG. 5, for purposes of clarity the intermediate support plate 410 is shown suspended above the interposers 512 and 514. If it is desired to lower the intermediate support plate 410 below the tops of the interposers 512 and 514, so that simplexed copied sheets of paper can be deposited into the container 401 for duplex copying, a command from the duplex printing mechanism will be sent to an activating means such as solenoid 540. Upon receipt of the command signals, solenoid 540 will extend the plunger 542 which will contact the ends of the extended contact portions 522 and 520 of arms 502 and 504 respectively. As the plunger contacts the ends of the extended contact portions the arms are caused to pivot about the pivot points 508 and 510 causing the interposers 512 and 514 to move through the slot in the front wall of container 401. At the same time, the solenoids 460 and 462 of FIG. 4 are activated to lower the intermediate support plate 410 to a position lower than the tops of interposers 512 and 514.

The arms are normally in the first position because of the biasing actions of the springs 524 and 526. Hence, when the cassette 400 is removed from the copier and papers are laid therein the intermediate support plate can only be lowered to the tops of the interposers. When the cassette which is now fully loaded is attached to the copier the extended contact members 520 and 522 are disposed in close proximity to the solenoid 540 and plunger 542. See FIG. 1. The solenoid 540 is attached to suitable support framework connected to the frame 110 of the copier.

In the preferred embodiment of FIG. 1, photoconducting drum 12 is adapted to receive two pages of information for each complete rotation of the drum, that is, for each half rotation of the drum a full page of data is imaged by the copier on a half of a circumference of the drum 12. Cams 120 and 122 are attached to the side of the drum and as they rotate past microswitch 124 they activate the switch sending a signal out over line 126 to the copier controller designated generally 600 in FIG. 6. One of the functions of the controller 600 is to synchronize the imaging of data on the drum, the feeding of sheets of paper, and the rotation of the drum. The controller 600 comprises a microcontroller 602 which is capable of being programmed. The signals from microswitch 124 are transmitted over line 126 to the controller 600 and are used as timing signals for the microcontroller. The program within the microcontroller 602 generates data for the controller 600 which in response activates one of the rollers 74 or 76 to feed a sheet of paper into the paper feeding means along the feed path to the transfer means. Copying is performed on one side of the sheet of paper as described above and the sheet of paper is moved along the dashed path 90 over the fuser or heating platen 94 through roller assembly 96 where it is deflected by deflection plate 98 and by return plate 100 into the duplex roller assembly 102. If this is a sheet of paper requiring duplex copying then the controller 600, in response to the program, reverses roller assembly 102 propelling the sheet of paper into the paper feeding station 70. After an appropriate time, the controller 600 in response to the program activates roller 74 to feed the sheet of paper back into the paper feed path for printing on the second side.

Figure 6:
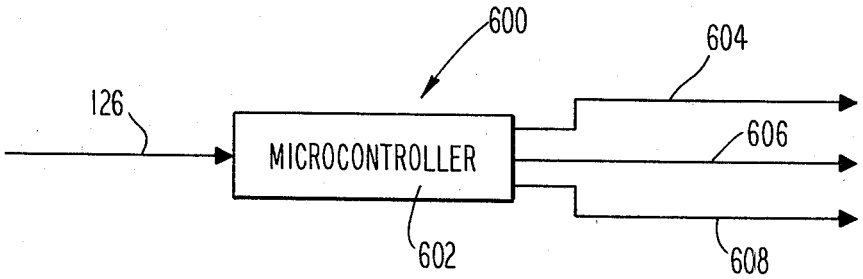
FIG. 6 is a preferred embodiment block diagram schematic of the control portion of the invention of FIG. 1.

FIG. 6 is a block diagram schematic of the controller 600 of the laser printer of FIG. 1. It shows microcontroller 602 which in the preferred embodiment is an Intel 8748 microprocessor. The microcontroller 602 receives timing signals over line 126 from the microswitch 124. It uses these timing pulses to synchronize an internal timing clock contained within the microcontroller 602. The microcontroller uses the synchronized clock to execute a program which provides the proper signals to drive the duplex roller assembly 102, the feed rollers 74 and 76, and the solenoids 460, 462 and 540 at the appropriate times. Microcontroller 602, sends signals over line 604 to rotate either roller 74 or roller 76 depending on which paper feed station is to be used. One manner in which this might be accomplished is for the microcontroller 602 to furnish a selection signal to a relay and when a timing signal is received from the microswitch 124 directly at the relay a solenoid is activated to engage a clutch to drive either roller 74 or 76 depending on which selection was made by the microcontroller 602. These details are not shown in FIG. 1 since they are well known to one of ordinary skill in the art. Further, it is not the only way in which roller 74 and 76 could be activated.

In duplex copying when a plurality of sheets of paper is desired, a first original is placed on glass 28 and microcontroller 602 is accordance with this programming selects paper feeding station 70 and 72 via line 604 to feed a plurality of sheets of paper through the printing mechanism. As the first sheet of paper arrives at the duplex roller assembly 102, microcontroller 602 commands the roller assembly to rotate in a direction to deposit the sheets of paper in paper feeding station 70. This is done by command over line 606 to the electromagnetic clutches 202 or 204. At the same time, solenoids 460, 462, and 540 are activated by command from the microcontroller 602 over line 608 to lower the intermediate support plate 410 in a manner described above in FIGS. 4 and 5. This allows the simplexed copied plurality of sheets of paper to be deposited in the paper feeding stations 70.

Next a second original is placed on glass 28 and microcontroller 602 deactivates solenoids 460, 462 and 540 via line 608; activates roller 74 via line 604; and changes the direction of rotation of the roller assembly 102 via line 606. The duplex sheets when they arrive at roller assembly 102 will then be discharged with duplex copying of first and second originals thereon.

While the present invention has been disclosed in connection with the preferred embodiment thereof it should be understood that there may be other embodiments which fall within the spirit and scope of the invention as defined by the following claims.

What is claimed is:

1. An apparatus for holding paper in a duplex copying machine comprising:

a container removably connected to said duplex copying machine for holding a stack of paper having a plurality of sheets;

alignment means mounted within said container for aligning the edges of said paper sheets within said stack, said alignment means further comprising an extended portion extending partially over the top sheet of paper in said stack when said stack is placed in said container, whereby said stack of paper is partially confined within said container;

an intermediate support plate within said container upon which said stack of paper rests when placed in said container;

biasing means connected to said intermediate support plate for biasing said stack of paper against said extended portion; and automatic lowering means connected to said intermediate support plate for lowering said intermediate support plate with said stack of paper thereon to a remote position against the force of said biasing means in response to a duplex command from said machine, whereby sheets of paper containing simplex copying and requiring duplex copying can be placed on the top of said stack of paper under said extended portion.

2. The invention of claim 1 wherein said container includes a slot in each of opposite side walls, and wherein said automatic lowering means comprises:

extension members connected to opposite sides of said intermediate support plate, said extension members extending through said slots;

a pair of contact members which come in close proximity to the tops of said extension members when said container is mounted to said duplex copying machine;

and first activating means connected to said duplex copying machine and to which said contact members are connected, said activating means for moving said contact members to engage and lower said extension members in said slots in response to said duplex command.

3. The invention of claim 1 wherein said apparatus further comprises an automatic stop means connected between said intermediate support plate and the bottom of said container for stopping the intermediate support plate at a first location above said remote location within said container when said stack of paper is placed therein in the absence of said duplex command and for allowing said intermediate support plate with said stack of paper to be lowered to said remote position by said automatic lowering means in response to said duplex command.

4. The invention of claim 3 wherein said automatic stop means comprises at least one arm pivotally mounted to said cassette, said arm movable between a first position and a second position; an interposer connected to said arm and disposed between said intermediate support plate and said bottom when said arm is in said first position; an activating means connected to said duplex copying machine and disposed in close proximity to said container when said container is attached to said duplex copying machine for engaging said arm and moving said arm to said second position upon receipt of said duplex command.

* * * * *